US006349884B1

(12) United States Patent
Thome et al.

(10) Patent No.: US 6,349,884 B1
(45) Date of Patent: Feb. 26, 2002

(54) PROCESS AND DEVICE FOR MOUNTING A SUB-ASSEMBLY COMPRISING AT LEAST ONE COATING PRODUCT SPRAY, ON A MOBILE PART OF A ROBOT

(75) Inventors: Caryl Thome, Saint Egreve; Philippe Provenaz; Louis Sentis, both of Grenoble, all of (FR)

(73) Assignee: Sames S.A., Meylan (FR)

( * ) Notice: Subject to any disclaimer, the term of this patent is extended or adjusted under 35 U.S.C. 154(b) by 0 days.

(21) Appl. No.: 09/642,823

(22) Filed: Aug. 22, 2000

(30) Foreign Application Priority Data

Aug. 30, 1999 (FR) ..... 99 10993

(51) Int. Cl.[7] ..... B05B 17/00

(52) U.S. Cl. ..... 239/1; 239/305; 239/390; 239/391; 239/600; 901/30; 901/43; 118/323

(58) Field of Search ..... 239/1, 302–305, 239/320, 329, 390, 391, 392, 587.1, 600, DIG. 14, 690; 901/30, 41, 43; 118/323

(56) References Cited

U.S. PATENT DOCUMENTS

| | | | | |
|---|---|---|---|---|
| 4,512,709 A | * | 4/1985 | Hennekes et al. | 901/41 X |
| 4,604,787 A | * | 8/1986 | Silvers, Jr. | 901/30 X |
| 4,613,082 A | * | 9/1986 | Gimple et al. | 239/600 X |
| 4,697,741 A | * | 10/1987 | Dengler et al. | 239/391 |
| 4,785,760 A | * | 11/1988 | Tholome | 239/305 X |
| 4,944,459 A | * | 7/1990 | Watanabe et al. | 901/43 X |
| 5,029,755 A | * | 7/1991 | Schmidt et al. | 239/390 X |

FOREIGN PATENT DOCUMENTS

| | | |
|---|---|---|
| DE | 37 21 235 | 2/1988 |
| DE | 256 231 | 5/1988 |
| GB | 2 196 314 | 4/1988 |

OTHER PUBLICATIONS

Patent Abstracts of Japan, Publication No. 59049867, Publication Date Mar. 22, 1984.
Patent Abstracts of Japan, Publication No. 53056237, Publication Date May 22, 1978.

* cited by examiner

*Primary Examiner*—Steven J. Ganey
(74) *Attorney, Agent, or Firm*—Browdy and Neimark

(57) ABSTRACT

A process and device for mounting a sub-assembly that includes at least one coating product spray on a mobile part of a robot. The method includes:—engaging a support fast with the mobile part in a ring connected to the sub-assembly;—rotating this ring with respect to this support by bringing first projections provided on the periphery of the ring opposite second projections provided on the periphery of this support; and—displacing a bearing plate, connected to the mobile part, in the direction of this sub-assembly, until the plate exerts a bearing effort on the sub-assembly, the bearing effort being transmitted to the ring, with the result that the first and second projections are brought into mutual engagement. The device includes a ring connected to the sub-assembly and provided with first projections and a support, fast with the mobile part and provided with second projections, while a bearing plate borne by the mobile part is adapted to be displaced with respect to this support, the first and second projections being adapted to be brought into mutual engagement.

10 Claims, 5 Drawing Sheets

PROCESS AND DEVICE FOR MOUNTING A SUB-ASSEMBLY COMPRISING AT LEAST ONE COATING PRODUCT SPRAY, ON A MOBILE PART OF A ROBOT

The present invention relates to a process and device for mounting a sub-assembly, comprising at least one spray for spraying coating product, on a mobile part of a robot.

Automatic coating product spray installations must be capable of considerable flexibility in order to minimize the investments that they involve. Different types of coating product sprays exist at the present time, such as rotary sprays, pneumatic sprays and electro-pneumatic sprays. On the other hand, the nozzle, the possible bowl and the possible electrostatic charge system must be adapted, as a function of the type of coating product, which may be a base paint, a varnish, a metallic paint, a solvent-based or hydrosoluble paint.

In known installations, only one type of spray is generally provided to be used. For example, in the case of an installation for coating automobile vehicle bodies, it is known to equip a coating booth with one type of spray for substantially the whole life duration of the booth. It might be envisaged to use different booths, each comprising a type of spray devoted to a type of application, but this would involve considerable investments which could not be economically worthwhile.

It is a particular object of the present invention to overcome these drawbacks by proposing a process and a device which reliably and rapidly mount a sub-assembly on a robot and which, during operation, adapt the type of spray used to the type of application desired and/or to the type of product to be sprayed.

To that end, the invention relates to a process for mounting a sub-assembly, comprising at least one coating product spray, on a mobile part of a robot, characterized in that it consists in:

- engaging a support fast with the mobile part in a ring connected to said sub-assembly;
- rotating this ring with respect to this support by bringing first projections provided on the periphery of said ring opposite second projections provided on the periphery of said support, and
- displacing a bearing plate, connected to this mobile part, in the direction of this sub-assembly, until this plate exerts a bearing effort on the sub-assembly, this bearing effort being transmitted to the ring, with the result that the first and second projections are brought into mutual engagement.

Thanks to the invention, the ring and the support together constitute a system of locking by rotation, similar to a bayonet system or to a so-called "quarter-turn" system, even if the relative angle of rotation of the ring with respect to the support is not necessarily 90°. The movement of the bearing plate makes it possible to rigidify the assembly produced by the ring and the support and also to ensure tightness of fluid and/or electrical connections made at the interface between the robot and the sub-assembly in question. The process of the invention induces solely a movement of rotation of the ring and a movement of longitudinal displacement of the bearing plate, which may be a translation, these movements being mechanically simple and adapted to be effected particularly rapidly, with the result that the mounting of the sub-assembly and dismantling thereof may be compatible with the production rates of the automobile industry.

According to an advantageous aspect of the invention, the displacement of the bearing plate is obtained by supplying air under pressure to a closed volume defined between the support and the bearing plate. This mode of control of displacement of the piston makes it possible to obtain a considerably rapid movement and intense bearing force of the bearing plate on the sub-assembly. In this way, the effort of mutual engagement of the projections depends on the supply pressure of this closed volume.

The invention also relates to a device for carrying out the process as defined hereinbefore and, more specifically, to a device which comprises:

- a ring connected to the sub-assembly and provided, on its periphery, with first projections;
- a support fast with the mobile part and provided, on its periphery, with second projections;
- a bearing plate borne by the mobile part and adapted to be displaced with respect to the support in a direction substantially parallel to a central axis of this support;
- the first and second projections being adapted to be brought into mutual engagement when the ring surrounds the support, the bearing plate being adapted to exert on the sub-assembly an effort of locking of these projections.

According to advantageous aspects of the invention, the first and second projections comprise studs made on an inner radial surface of the ring and on an outer radial surface of the support and adapted to be aligned when the ring is disposed around the support. In that case, the surfaces of the studs intended to come into mutual abutment are advantageously provided with respective centering means, these centering means being able to comprise a housing, provided on one of the surfaces of one of the studs for receiving a projecting element made on the corresponding surface of another stud.

The bearing plate comprises orifices for the passage of fluid supplying the spray, these orifices being adapted to be aligned with corresponding orifices in the sub-assembly, and/or an electrical connector adapted to cooperate with an electrical connector provided on the sub-assembly for supplying the spray with current. Thanks to the mobile nature of the bearing plate, a satisfactory seal is obtained between the orifices of the bearing plate and those of the sub-assembly, while the electrical connection made thanks to the connectors is reliable and protected from its environment.

The bearing plate is provided with an orifice for the passage of a control rod of a piston of a reservoir incorporated in the sub-assembly for supplying coating product to the spray or sprays.

A closed volume is defined between the support and the bearing plate, this closed volume being adapted to be selectively connected to a source of pressurized air, the value of the pressure in this volume enabling the displacement of the bearing plate to be controlled.

The ring is provided with projections adapted to cooperate with projections with corresponding shapes provided on a manoeuvring ring belonging to a station for cleaning/filling the sub-assembly for controlling the displacement of this ring in rotation.

The invention will be more readily understood and other advantages thereof will appear more clearly on reading the following description of an embodiment of a device for mounting a sub-assembly on a mobile part of a robot and of a process for implementing it, given solely by way of example and made with reference to the accompanying drawings, in which:

FIG. 1 schematically shows an installation for spraying coating product, during operation.

Figure 1:
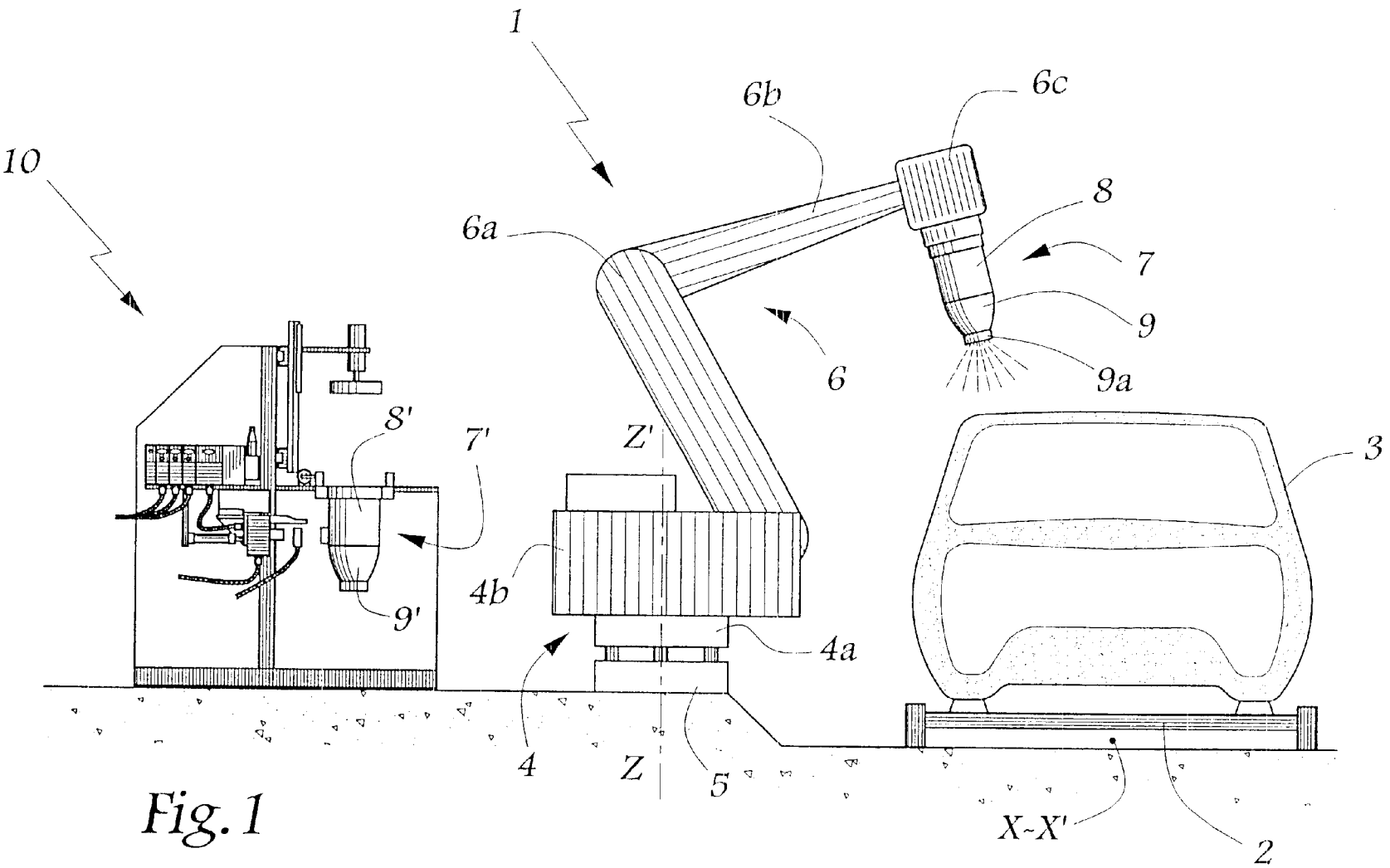

Referring now to the drawings, and firstly to FIG. 1, an automat or robot 1 is disposed near a conveyor 2 transporting objects to be coated, in the present case automobile vehicle bodies 3. The robot 1 is of the multi-axis type and comprises a chassis 4 mobile on a guide 5 extending parallel to the direction of conveyance X–X'. An arm 6, supported by the chassis 4, comprises a plurality of segments 6*a*, 6*b*, 6*c* articulated with respect to one another. The chassis 4 is also constituted by parts 4*a* and 4*b* articulated with respect to each other about a substantially vertical axis Z–Z'. The segment 6*c* of the arm 6 supports a sub-assembly 7 in which are provided a reservoir 8 of coating product and a spray 9. The spray 9 is of the electrostatic and rotary type and it bears a bowl 9*a* intended to be driven at high speed by an air turbine integrated in the spray 9. When a vehicle body 3 is in place or advances at the level of the robot 1, the sub-assembly 7 is disposed opposite the body and the spray 9 is activated in order to coat this body with the product contained in the reservoir 8. The quantity of products present in the reservoir 8 is adapted to the surface of the body 3 to be coated.

When the body coating operation has terminated, and while a second body is advancing towards robot 1, the latter is oriented towards a cleaning/filling station 10 located in its vicinity, inside the spray booth.

Figure 2:
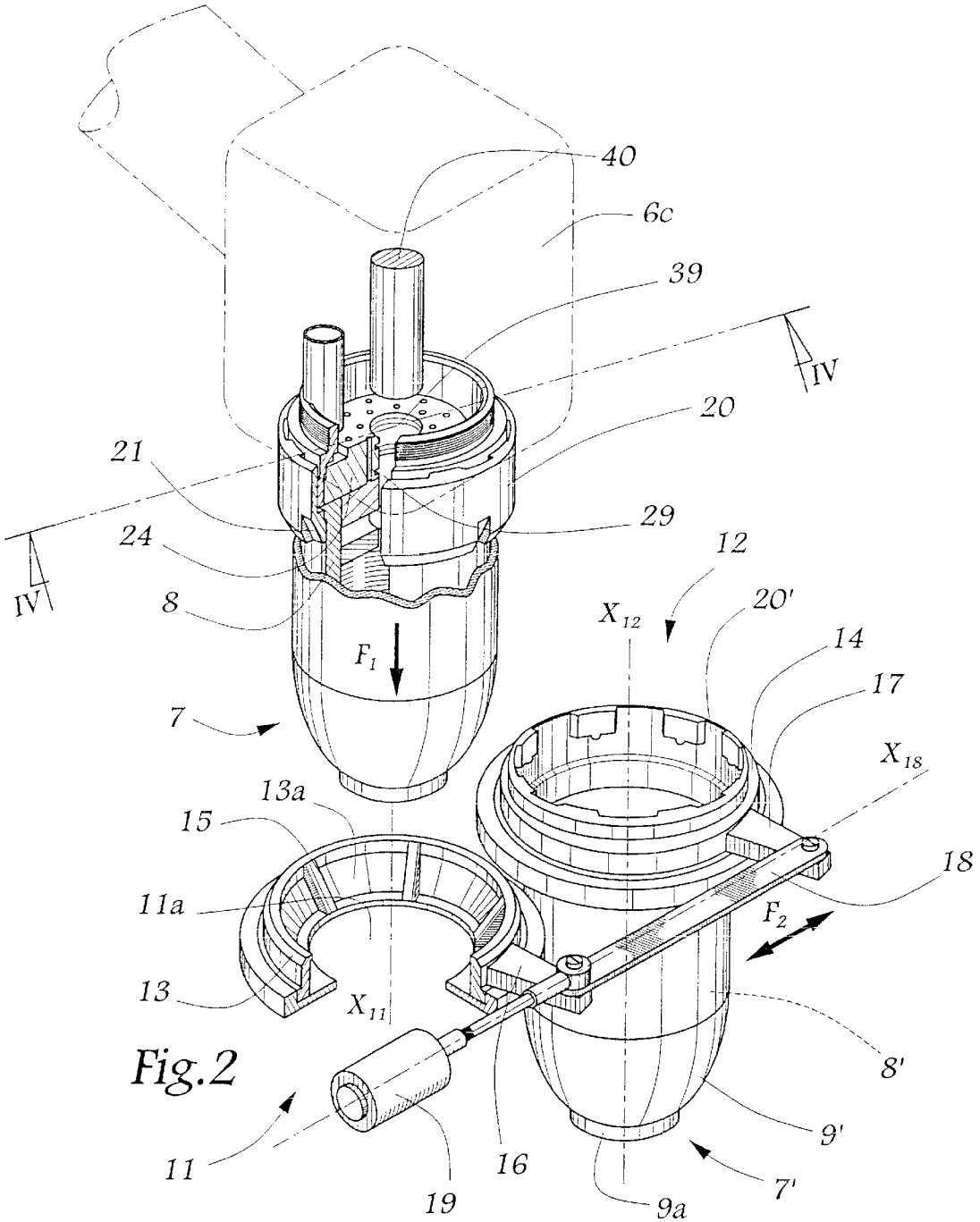
FIG. 2 is a partial perspective view, with parts torn away, of part of a cleaning/filling station of the installation of FIG. 1.

As is clearly apparent in FIG. 2, this station 10 is provided with two areas 11 and 12 for receiving sub-assemblies of the type such as sub-assembly 7. More precisely, area 11 is empty and ready to receive sub-assembly 7, while area 12 contains a similar sub-assembly 7', which likewise comprises a reservoir 8' and a spray 9', similar to those of sub-assembly 7. Sub-assemblies 7 and 7' may be alternately mounted on the segment 6*c* of arm 6.

Sub-assembly 7 is brought towards area 11 and introduced therein by a movement of descent of segment 6*c* represented by arrow $F_1$ in FIG. 2. It thus passes through a ring 13 defining the inlet orifice 11*a* of the area 11. A similar ring 14 is provided at the upper level of area 12.

Sub-assembly 7 bears a ring 20 of which the lower part is provided with notches 21 which are provided to receive ribs 15 made on the inner radial surface 13*a* of the ring 13.

In this way, when one of the sub-assemblies 7 or 7' is disposed in an area 11 or 12, the cooperation of elements 15 and 21 makes it possible to render ring 13 or 14 and ring 20 or 20' fast in rotation with this sub-assembly.

Rings 13 and 14 are each fast with a connecting rod 16 or 17, these connecting rods being joined together by a rod 18 controlled by a drive jack 19 in a movement of translation, parallel to its largest axis $X_{18}$ and represented by arrow $F_2$. In this way, jack 19 makes it possible to drive rings 20 and 20' of sub-assemblies 7 and 7' in rotation about the central axes $X_{11}$ and $X_{12}$ of areas 11 and 12.

Figure 3:
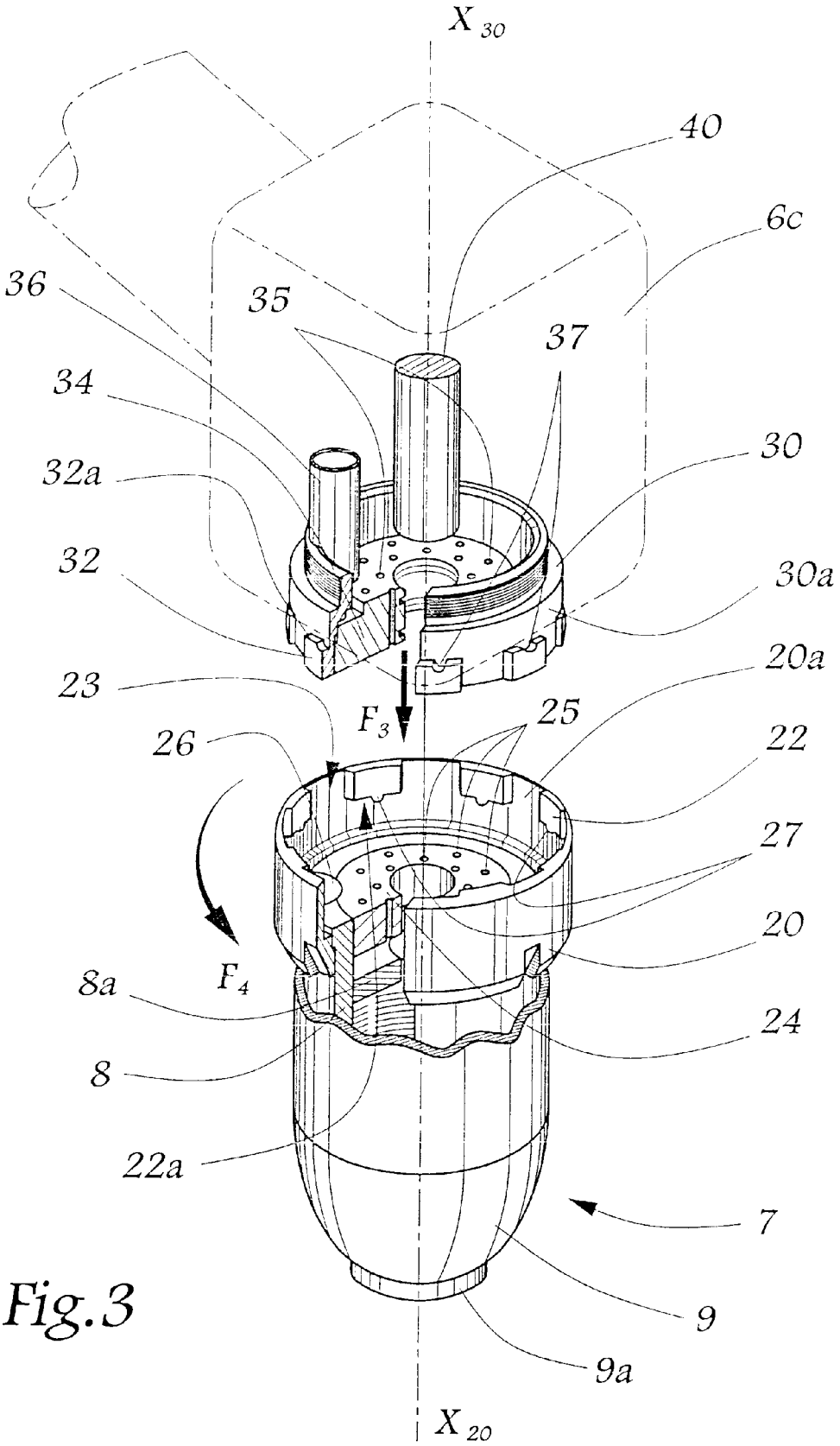
FIG. 3 is an exploded perspective view of the end of the arm of a robot of the installation of FIG. 1 and of a sub-assembly intended to be mounted on this robot.

As is more clearly visible in FIG. 3, the ring 20 is provided, on its inner radial surface 20*a*, with studs 22 separated by free areas 23.

The segment 6*c* of the arm 6 is equipped with a support 30, of substantially cylindrical shape, and whose outer radial surface 30*a* has a diameter slightly smaller than that of the surface 20*a*.

During mounting and dismantling of a sub-assembly 7 or 7' on and from the segment 6*c*, the respective central axes $X_{20}$ and $X_{30}$ of elements 20 and 30 merge.

The surface 30*a* is also equipped with studs 32 whose width is smaller than that of areas 23.

A bearing plate 24 is formed in the upper part of the sub-assembly 7 and is provided with orifices 25 for the passage of air or other fluids for controlling the reservoir 8 and the spray 9 and for monitoring these devices. An electrical connector 26 is also provided for supplying the spray 9 with high voltage.

A corresponding bearing plate 34 is defined in the central part of the support 30 and likewise comprises orifices 35 for the passage of air and an electrical connector 36 connected to a high-voltage unit (not shown).

The orifices 25 and 35, on the one hand, and the connectors 26 and 36, on the other hand, are provided to be aligned when the sub-assembly 7 is mounted on the segment 6*c*.

A sub-assembly 7 or 7' is mounted on the segment 6*c* while this sub-assembly is in place in one of the receiving areas 11 or 12 and its ring 20 is in abutment on one of the rings 13 or 14. In this configuration, the support 30 is introduced in the ring 20 as represented by arrow $F_3$ in FIG. 3, the studs 32 passing in areas 23, between the studs 22 of the ring 20. A movement of rotation represented by arrow $F_4$ is then imparted to ring 20 thanks to the activation of the jack 19 which drives the ring 13 and 14 and thereby the ring 20, which has the effect of bringing studs 22 opposite studs 32. We are then in the configuration of FIG. 4.

In this configuration, the lower surfaces 22*a* of the studs 22 directed towards the sub-assembly 7 and the upper surfaces 32*a* of the studs 32 directed towards segment 6*c*, are opposite one another.

Surfaces 22*a* bear a catch 27 projecting towards the bearing plate 24. Furthermore, surfaces 32*a* are each provided with a notch 37 for receiving a catch 27.

In this way, after the movement of rotation $F_4$, a catch 27 of each surface 22*a* is opposite a notch 37 of a stud 32, the elements 27 and 37 each being provided in the central part of surfaces 22*a* and 32*a*.

The bearing plate 34 is mobile in the direction of axis $X_{30}$ with respect to support 30. In effect, an annular volume 38 is defined between the inner surface of the support 30 and the outer surface of the bearing plate 34, this volume 38 being connected, by a controlled line (not shown), to a source of compressed air, likewise not shown.

Figure 5:
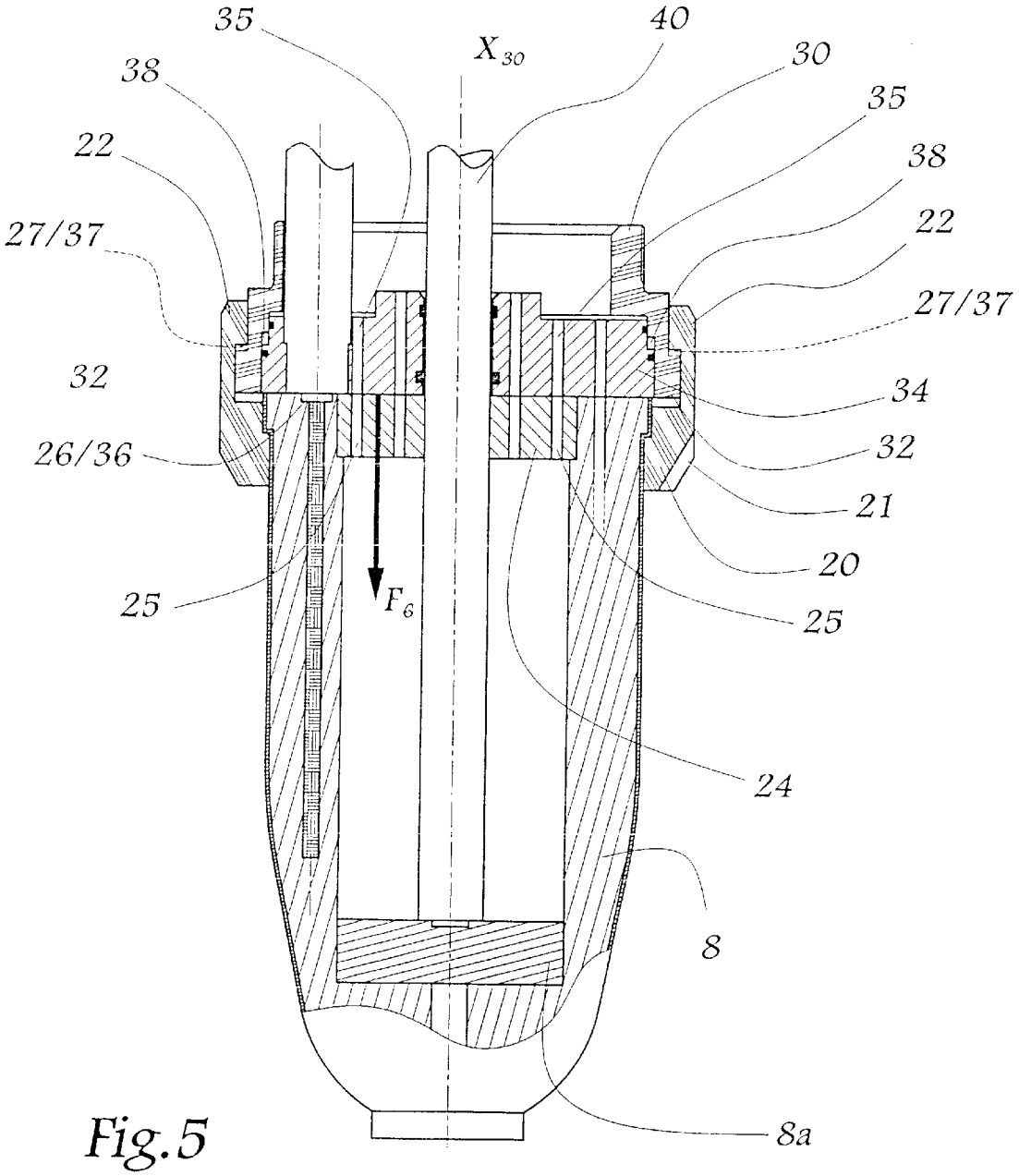
FIG. 5 is a view similar to FIG. 4 when the elements have been assembled.

After the rotation $F_4$, the volume 38 is pressurized, which has the effect of displacing, in translation parallel to axis $X_{30}$ and as represented by arrow $F_5$, the bearing plate 34 up to firm abutment on the bearing plate 24, with the result that the seal of the joins between orifices 25 and 35, on the one hand, and between the connectors 26 and 36, on the other hand, is effected in sure fashion while this effort, represented by arrow $F_6$ in FIG. 5, has the effect of applying the surfaces 22*a* on the surfaces 32*a* and of causing the catches 27 to penetrate in the notches 37, which ensures an efficient mechanical locking of the sub-assembly 7 on the segment 6*c*.

The cooperation of the catches 27 and the notches 37 makes it possible to obtain, under the effect of the effort $F_6$, a blocking in rotation of the ring 20 and of the support 30. In addition, in the event of loss of pressure in the volume 38, the device for actuation of the piston 8*a* maintains an axial effort on the ring 20, which, thanks to elements 27 and 37, ensures an efficient mechanical locking.

The bearing plate 24 is also provided with a central orifice 29 while the bearing plate 34 is provided with a central orifice 39 of the same internal cross-section in which may slide a rod 40 controlling the position of the piston 8*a* of the reservoir 8. It is thus possible, in the configuration of FIG.

5, to control the position of the piston 8*a*, in particular for supplying the spray 9, thanks to the control of the rod 40 which may be effected precisely by means of an actuator (not shown) provided in the segment 6*c*.

Figure 4:
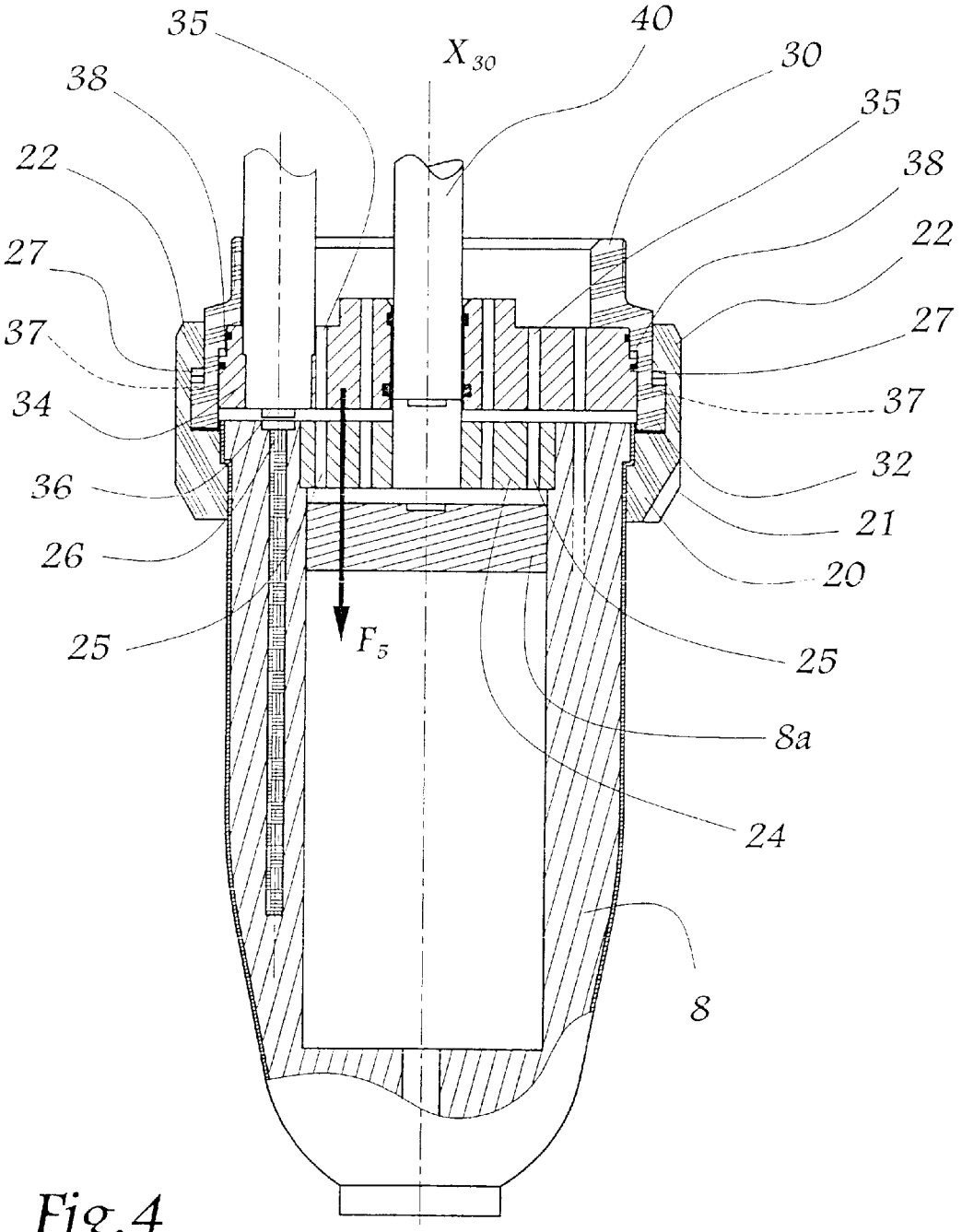
FIG. 4 is a longitudinal section through the elements of FIG. 2 during assembly.

During the operations of mounting and of dismantling of a sub-assembly 7 on and from the segment 6*c*, the rod 40 is retracted inside the sub-assembly 6, as shown in FIGS. 3 and 4.

When a sub-assembly 7 is to be disconnected from the segment 6*c*, for example during the step following the one shown in FIG. 2, the pressure in the volume 38 is returned to atmospheric pressure, with the result that the effort $F_5$ is eliminated, the rod 40 being retracted.

It is then possible to drive the ring 20 in rotation about axes $X_{20}$–$X_{30}$ in the direction of arrow $F_4$ or in the opposite direction, so as to bring studs 22 and 32 into a configuration such that they are no longer opposite. The segment 6*c* may then be raised, by a movement opposite that represented by arrow $F_3$, and brought opposite the second sub-assembly 7' which may be mounted on the segment 6*c*, as indicated hereinabove.

The elements constituting the device of the invention are made of electrically insulating material, for example of appropriate plastics material. This makes it posible to avoid the risks of electric arcs between parts taken to high voltage, such as the bowl of the spray and the contents of the reservoir in the case of a spray of electrostatic type and of a hydrosoluble coating product, on the one hand, and parts at earth potential, such as the handle of the robot, on the other hand. The configuration of the device is such that it does not comprise any electrically conducting element near the parts at high voltage.

The invention therefore allows a rapid change of sub-assembly at the end of the arm of a multi-axis robot, which makes it possible to paint bodies 3 at a high rate, the reservoir 8 and the spray 9 being cleaned in masked time, during use of the corresponding elements 8' and 9' of the sub-assembly 7'.

The invention has been shown with a multi-axis robot and a sub-assembly 7 comprising a reservoir; however, it is applicable to any type of robot and to any type of sub-assembly, whether or not it integrates a reservoir for supplying the spray or sprays in question.

According to variant embodiments of the invention, the ring 20 may be mounted to rotate freely about the sub-assembly 7. The sub-assembly may comprise two or more sprays which may be of any known type. The invention has been shown with a movement $F_3$ of introduction of the support 30 in the ring 20. It would also be possible to use a reverse movement whereby the ring 20 would be displaced in order to be engaged around the support 30. In any case, the support 30 is engaged in the ring within the meaning of the present invention.

Thanks to the invention, it is possible to rapidly change the sub-assembly 7 mounted on the arm 6 of a robot 1 and, in particular, to change the type of sub-assembly, sub-assemblies 7 and 7' not necessarily being identical. The characteristics of the spray 9, of the reservoir 8 or of the electrostatic charge system associated therewith, may thus be adapted as a function of the desired application.

What is claimed is:

1. Process for mounting a sub-assembly (7,7') comprising at least one coating product spray (9,9'), on a mobile part (6*c*) of a robot (6), said process comprising the steps of:

engaging ($F_3$) a support (30) fast with said mobile part in a ring (20) connected to said sub-assembly (7);

rotating ($F_4$) said ring (20) with respect to said support (30) by bringing first projections (22) provided on the periphery of said ring opposite second projections (32) provided on the periphery of said support, and displacing ($F_5$) a bearing plate (34), connected to said mobile part (6*c*), in the direction of said sub-assembly (7), until said plate exerts a bearing effort ($F_6$) on said sub-assembly, said bearing effort being transmitted to said ring, with the result that said first and second projections (22,32) are brought into mutual engagement.

2. Process according to claim 1, characterized in that the displacement ($F_5$) of said bearing plate is obtained by supplying pressurized air to a closed volume (38) defined between said support (30) and said bearing plate (34).

3. Device for mounting a sub-assembly (7,7') comprising at least one coating product spray (9,9'), on a mobile part (6*c*) of a robot (6), said device comprising:

a ring (20) adapted to be connected to the sub-assembly and having a periphery provided with first projections (22);

a support (30) adapted to be made fast with the mobile part (6*c*) and having a periphery provided with second projections (32), and a bearing plate (34) adapted to be borne by the mobile part (6*c*) and adapted to be displaced ($F_5$) with respect to the support (30) in a direction substantially parallel to a central axis ($X_{30}$) of said support;

said first and second projections (22, 32) being adapted to be brought into mutual engagement when said ring (20) surrounds said support (30), said bearing plate (34) being adapted to exert on said sub-assembly an effort ($F_6$) of locking of said projections.

4. Device according to claim 3, characterized in that said first and second projections comprise studs (22, 32) made on an inner radial surface (20*a*) of said ring (20) and on an outer radial surface (30*a*) of said support (30) and adapted to be aligned ($F_4$) when said ring (20) is disposed around said support (30).

5. Device according to claim 4, characterized in that said studs have surfaces (22*a*, 32*a*) intended to come into mutual abutment, said surfaces being provided with respective centering means (27, 37).

6. Device according to claim 5, characterized in that said respective centering means comprise a housing (37) on at least one surface (32*a*) of one of said studs (32) of one of said projections, and a projecting element (27) on at least one surface (22*a*) of one of said studs (22) of the other one of said projections, said housing being arranged to receive said projecting element.

7. Device according to claim 3, characterized in that said bearing plate (34) comprises orifices (35) for the passage of fluid supplying said spray (9), said orifices being adapted to be aligned with corresponding orifices (25) of said sub-assembly (7), and/or an electrical connector (36) adapted to cooperate with an electrical connector (26) provided on said sub-assembly for supplying said spray with current.

8. Device according to claim 3, characterized in that said bearing plate (34) is provided with an orifice (39) for passage of a rod (40) controlling a piston (8*a*) of a reservoir (8) incorporated in said sub-assembly (7) for supplying said spray (9) with coating product.

9. Device according to claim 3, characterized in that a closed volume (38) is defined between said support (30) and said bearing plate (34), said volume being adapted to be selectively connected to a source of pressurized air, the value of the pressure in said volume allowing displacement ($F_5$) of said bearing plate to be controlled.

10. Device according to claim 3, characterized in that said ring (20) is provided with projections (21) adapted to cooperate with projections (15) of corresponding shape provided on a manoeuvring ring (13, 14) belonging to a station (10) for cleaning/filling said sub-assembly (7) for controlling the displacement of said ring in rotation ($F_4$).

* * * * *